US010154769B2

(12) United States Patent
Larson

(10) Patent No.: US 10,154,769 B2
(45) Date of Patent: Dec. 18, 2018

(54) ADAPTER PLATE FOR A ROTARY FLOOR SCRUBBING MACHINE

(71) Applicant: Carlisle FoodService Products, Incorporated, Oklahoma City, OK (US)

(72) Inventor: Timothy J. Larson, Onalaska, WI (US)

(73) Assignee: CFS BRANDS, LLC, Oklahoma City, OK (US)

( * ) Notice: Subject to any disclaimer, the term of this patent is extended or adjusted under 35 U.S.C. 154(b) by 379 days.

(21) Appl. No.: 14/995,014

(22) Filed: Jan. 13, 2016

(65) Prior Publication Data

US 2016/0128535 A1 May 12, 2016

Related U.S. Application Data

(63) Continuation of application No. 13/829,116, filed on Mar. 14, 2013, now Pat. No. 9,265,397.

(60) Provisional application No. 61/669,550, filed on Jul. 9, 2012.

(51) Int. Cl.

| | |
|---|---|
| ***A47L 11/40*** | (2006.01) |
| ***A47L 11/283*** | (2006.01) |
| ***A47L 11/162*** | (2006.01) |
| ***A46B 13/00*** | (2006.01) |
| ***A47L 11/164*** | (2006.01) |

(52) U.S. Cl.

CPC ..... *A47L 11/4069* (2013.01); *A46B 13/008* (2013.01); *A47L 11/162* (2013.01); *A47L 11/283* (2013.01); *A47L 11/164* (2013.01); *A47L 11/4038* (2013.01)

(58) Field of Classification Search

CPC .. A47L 11/162; A47L 11/164; A47L 11/4069; A47L 11/4038; A46B 13/008; A46B 7/08; B24B 7/186; B24B 23/022; B24B 41/047; B24B 45/006; B24D 7/16

USPC ..... 15/180, 49.1, 98, 50.1; 451/353, 342, 451/360

See application file for complete search history.

(56) References Cited

U.S. PATENT DOCUMENTS

| | | | | |
|---|---|---|---|---|
| 1,685,485 | A * | 9/1928 | Finnell | A47L 11/293 15/180 |
| 2,300,138 | A | 10/1942 | Steele | |
| 2,541,526 | A | 2/1951 | Lundquist | |
| 3,055,030 | A | 9/1962 | Ardito | |

(Continued)

FOREIGN PATENT DOCUMENTS

| | | | |
|---|---|---|---|
| WO | 2008079944 | A2 | 7/2008 |
| WO | 2012098259 | A1 | 7/2012 |

OTHER PUBLICATIONS

Machine Translation of WO 2012/098259.

(Continued)

*Primary Examiner* — Andrew A Horton

(74) *Attorney, Agent, or Firm* — McAfee & Taft

(57) ABSTRACT

An apparatus is provided for the attachment of brushes to the drive system of rotary floor scrubbing machines. In one embodiment, the apparatus provides for a scrubbing plate assembly suitable for attachment to the drive system of a rotary floor scrubbing machine. The scrubbing plate assembly has a scrubbing plate and an adapter plate. When the adapter plate is aligned and in contact with a scrubbing plate, the adapter plate locks to the scrubbing plate by axial movement of said adapter plate relative to said scrubbing plate.

4 Claims, 19 Drawing Sheets

(56) References Cited

U.S. PATENT DOCUMENTS

| | | | |
|---|---|---|---|
| 3,600,735 | A | 8/1971 | Jerabek |
| 3,678,531 | A | 7/1972 | Hill |
| 4,094,034 | A | 6/1978 | Wilkins et al. |
| 4,337,546 | A | 7/1982 | Phillips |
| 4,409,702 | A | 10/1983 | Brown |
| 4,866,804 | A | 9/1989 | Masbruch et al. |
| 5,249,325 | A | 10/1993 | Wilen |
| 5,259,085 | A | 11/1993 | Marafante et al. |
| 5,619,770 | A | 4/1997 | Bell |
| 5,938,514 | A | 8/1999 | Amin et al. |
| 6,869,346 | B2 | 3/2005 | Wendt et al. |
| 2003/0115697 | A1 | 6/2003 | Deiterman |
| 2004/0255420 | A1 | 12/2004 | Shary et al. |

OTHER PUBLICATIONS

International Search Report and Written Opinion of the International Searching Authority dated Nov. 21, 2013, filed in related application PCT/US2013/047375.

* cited by examiner

ADAPTER PLATE FOR A ROTARY FLOOR SCRUBBING MACHINE

CROSS-REFERENCE TO RELATED APPLICATIONS

This application is a continuation of U.S. Non-Provisional application Ser. No. 13/829,116 filed Mar. 14, 2013, and claims the benefit of U.S. Provisional Application No. 61/669,550 filed Jul. 9, 2012, both of which are incorporated by reference.

BACKGROUND OF THE INVENTION

1. Field of the Invention

The present invention relates to rotary floor scrubbing machines and the attachment of scrubbing elements, such as brushes, thereto.

2. Description of the Related Art

Rotary floor scrubbing machines are used for a variety of floor care purposes including cleaning of carpeted, ceramic tiled, concrete, slate, quarry tiled and terrazzo floors and stripping and polishing of concrete, terrazzo and quarry tiled floors. A major impediment to supplying floor scrubbing elements, generally brushes or pads, is providing the correct specific element for the particular floor scrubbing machine. Generally, each floor scrubbing machine manufacturer has designed specific methods and hardware to attach and drive rotary floor scrubbing elements and at times has varied the methods and hardware within its own line by specific machine models. Although the general base geometry and theories to attach the scrubbing elements to the machines do not vary greatly, they do vary enough to make it difficult to order, supply and fit the correct scrubbing element to the correct machine. In light of this difficulty, a significant factor in many rotary floor scrubbing machine purchase decisions is how straightforward and easy it is to order and be supplied the correct product for a specific make and model of rotary floor scrubbing machine. Many end users utilize rotary floor pads instead of rotary brushes because they seldom need to change the pad driver or drive specific hardware and only have to obtain "consumable" rotary floor pads. The consumable rotary floor pads are not specific to any machine or model; however, pads are not as durable as brushes and, hence, must be replaced more frequently than brushes.

SUMMARY OF THE INVENTION

In accordance with one embodiment of the current invention there is provided a scrubbing plate assembly for use on a rotary floor scrubbing machine. The scrubbing plate comprises a scrubbing plate and an adapter plate. The scrubbing plate has a mounting side, a scrubbing side configured for having at least one scrubbing element positioned thereon, and a central edge defining a central aperture. The adapter plate has a first side configured to attach to a drive system of the rotary floor scrubbing machine, and a second side configured to attach to the scrubbing plate by a latching system. The latching system locks under axial movement of the adapter plate relative to the scrubbing plate when the second side of the adapter plate is aligned and in contact with the mounting side of the scrubbing plate.

In another embodiment of the current invention there is provided an adapter plate for use in attaching a scrubbing plate to a rotary floor scrubbing machine, wherein the scrubbing plate has a mounting side and a scrubbing side and a central edge defining a central aperture. The adapter plate comprises a first side configured to attach to a drive system of the rotary floor scrubbing machine, and a second side configured to attach to the scrubbing plate by a latching system. The latching system locks under axial movement of the adapter plate relative to the scrubbing plate when the second side of the adapter plate is aligned and in contact with the mounting side of the scrubbing plate.

In yet another embodiment there is provided a scrubbing plate for use with an adapter on a rotary floor scrubbing machine. The scrubbing plate comprises a mounting side, a scrubbing side and a central edge defining a central aperture. The mounting side is configured to attach the adapter plate by a latching system. The latching system locks under axial movement of the adapter plate relative to the scrubbing plate when the second side of the adapter plate is aligned and in contact with the mounting side of the scrubbing plate. The scrubbing side is configured to have at least one scrubbing element positioned thereon.

BRIEF DESCRIPTION OF THE DRAWINGS

FIG. 6 is a perspective view of the adapter plate and the attachment area of the scrubbing plate for the embodiment of FIG. 5.

FIG. 9 is an explosive view of another embodiment of the scrubbing plate assembly of the current invention. The adapter plate is illustrated with an integral hub key-type clutch structure.

FIG. 16 is a bottom plane view of the scrubbing plate of FIG. 14.

FIG. 18 is another embodiment of an adapter plate in accordance with the invention. The adapter plate utilizes the same latching system as the embodiment of FIG. 9.

FIG. 19 is a top plane view of the adapter plate of FIG. 18.

DESCRIPTION OF THE PREFERRED EMBODIMENTS

The present invention provides for an apparatus for the attachment to a variety of drive systems for rotary floor scrubbing machines. Such rotary machines use a variety of drive systems and more particularly use a variety of clutch systems for driving the scrubbing element or brush. Two common types of clutch assemblies are keyed-type drive assemblies and lug-type drive assemblies. Prior scrubbing plates and adapter plates have been designed to accept only one or a limited number of such clutch assemblies without altering to the scrubbing plate to accept a particular clutch assembly. Additionally, because of the difficulty in attaching such clutch assemblies to the scrubbing plate, often the clutch assembly has been replaced at the time of brush replacement, which adds to the cost of changing brushes.

Figure 1:
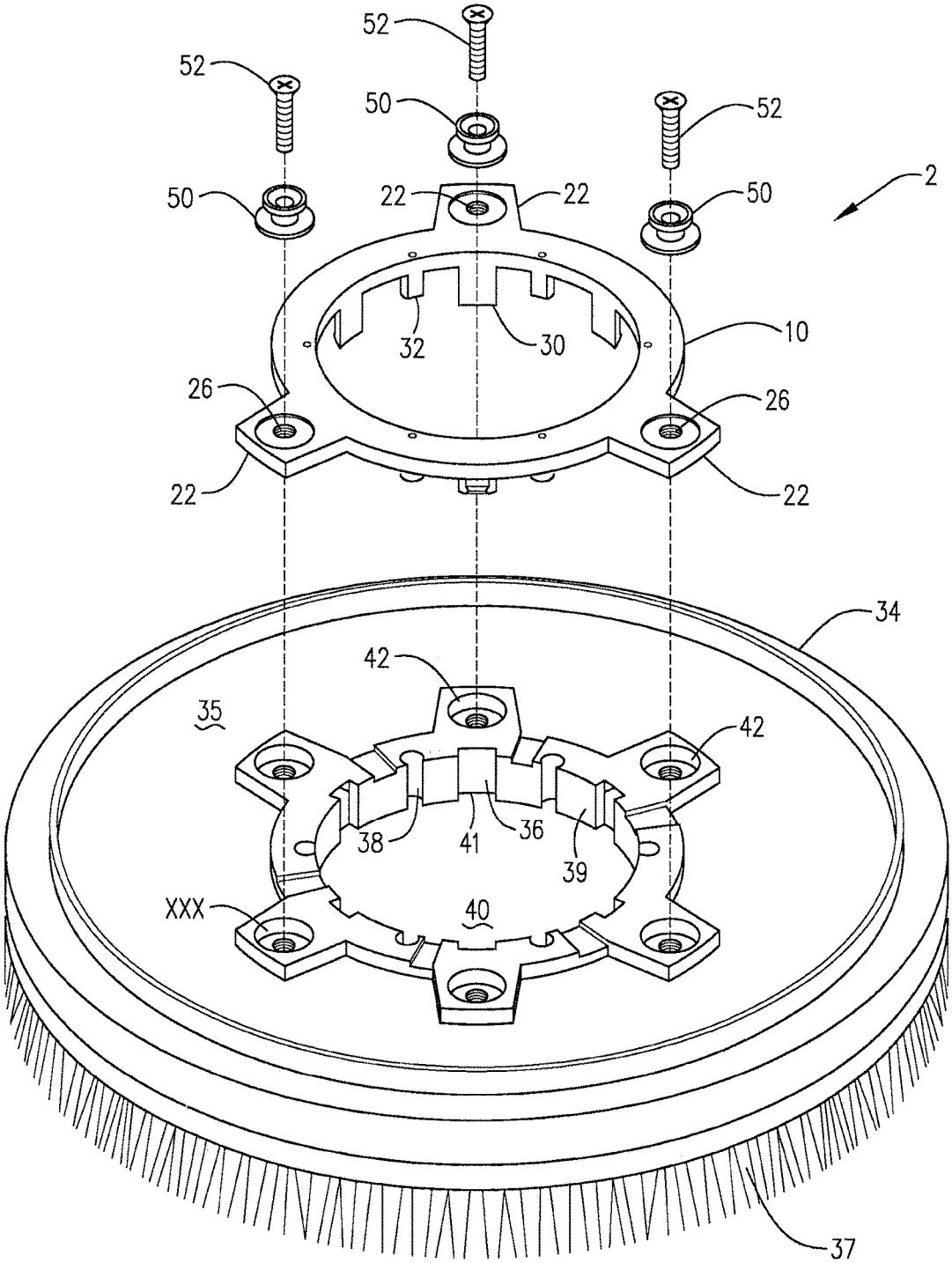
FIG. 1 is an explosive view of one embodiment of a scrubbing plate assembly in accordance with the invention. The scrubbing plate assembly is shown with clutch lugs.
Figure 2:
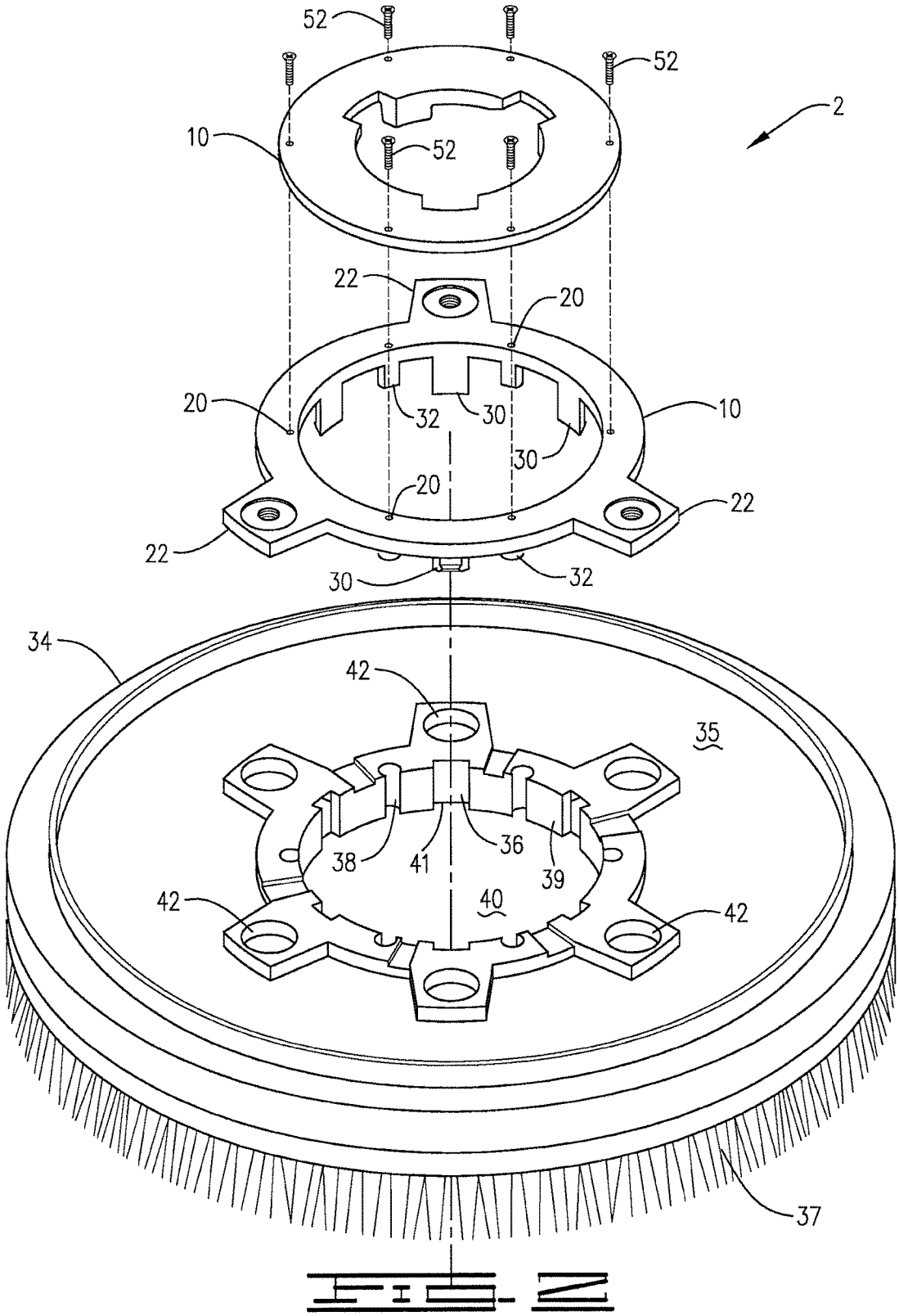
FIG. 2 is an explosive view of the embodiment of FIG. 1 but shown with a key-type clutch plate.

Turning now to FIGS. 1 and 2, a first embodiment of the scrubbing plate assembly 2 is illustrated. Scrubbing plate assembly 2 is suitable for use on a rotary floor scrubbing machine. Scrubbing plate assembly 2 has a scrubbing plate 34, sometimes called a brush plate or brush block. Scrubbing plate assembly 2 also has an adapter plate 10 and a clutch mechanism, shown as lugs 50 in FIG. 1 and key-type clutch plate 54 in FIG. 2.

Figure 3:
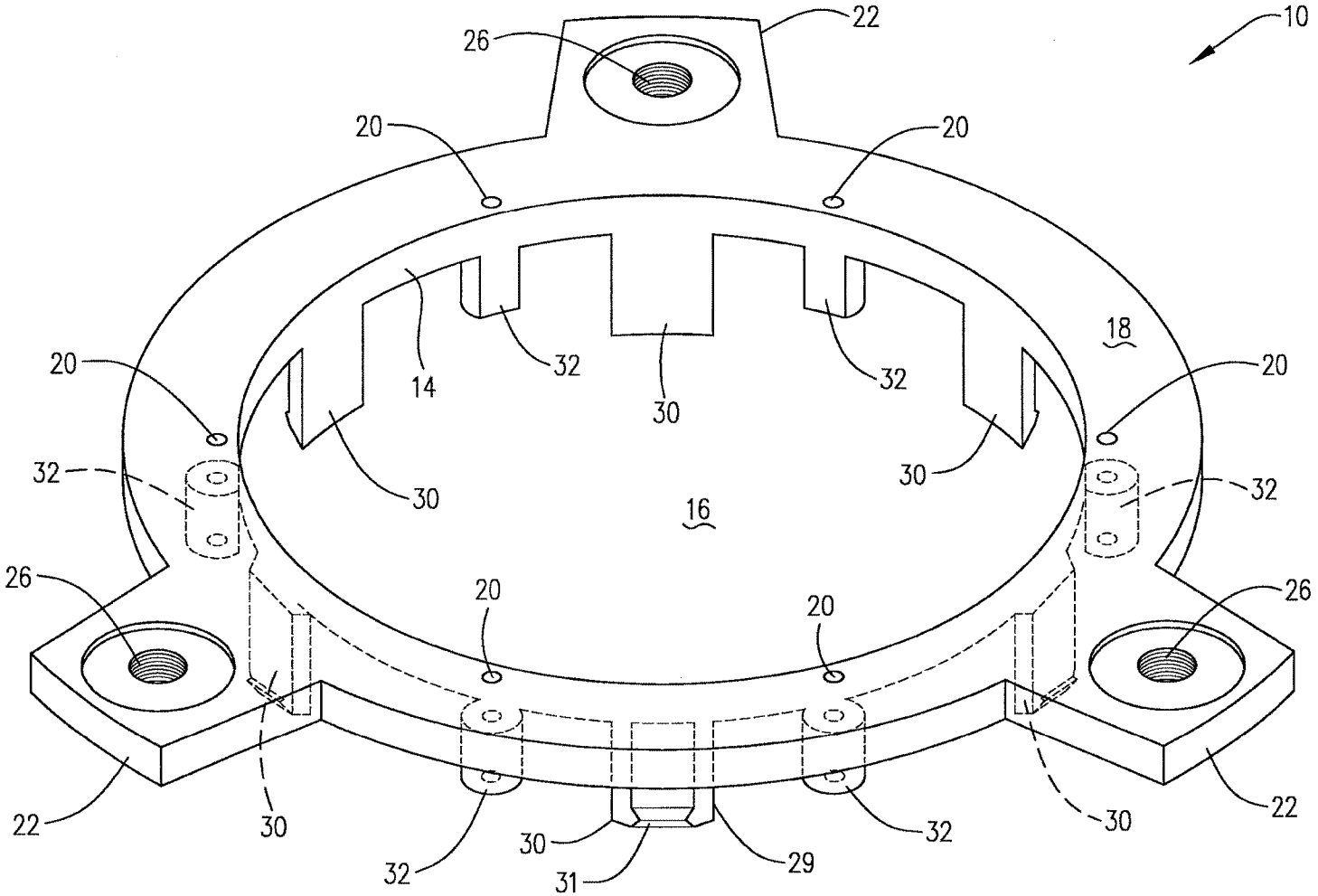
FIG. 3 is a top perspective view of the adapter plate of the embodiment of FIGS. 1 and 2.
Figure 4:
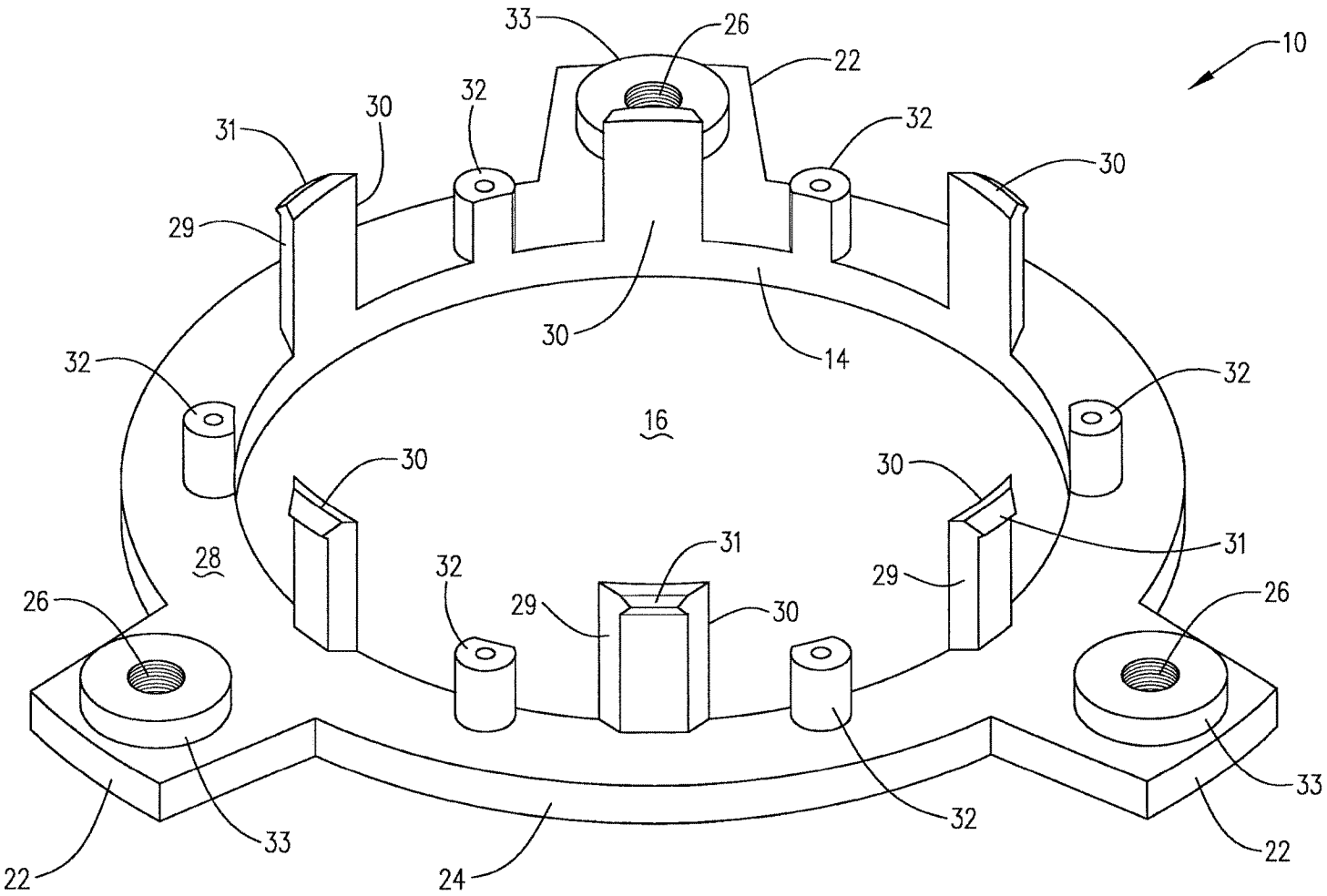
FIG. 4 is a bottom perspective view of the adapter plate of the embodiment of FIGS. 1 and 2.
Figure 5:
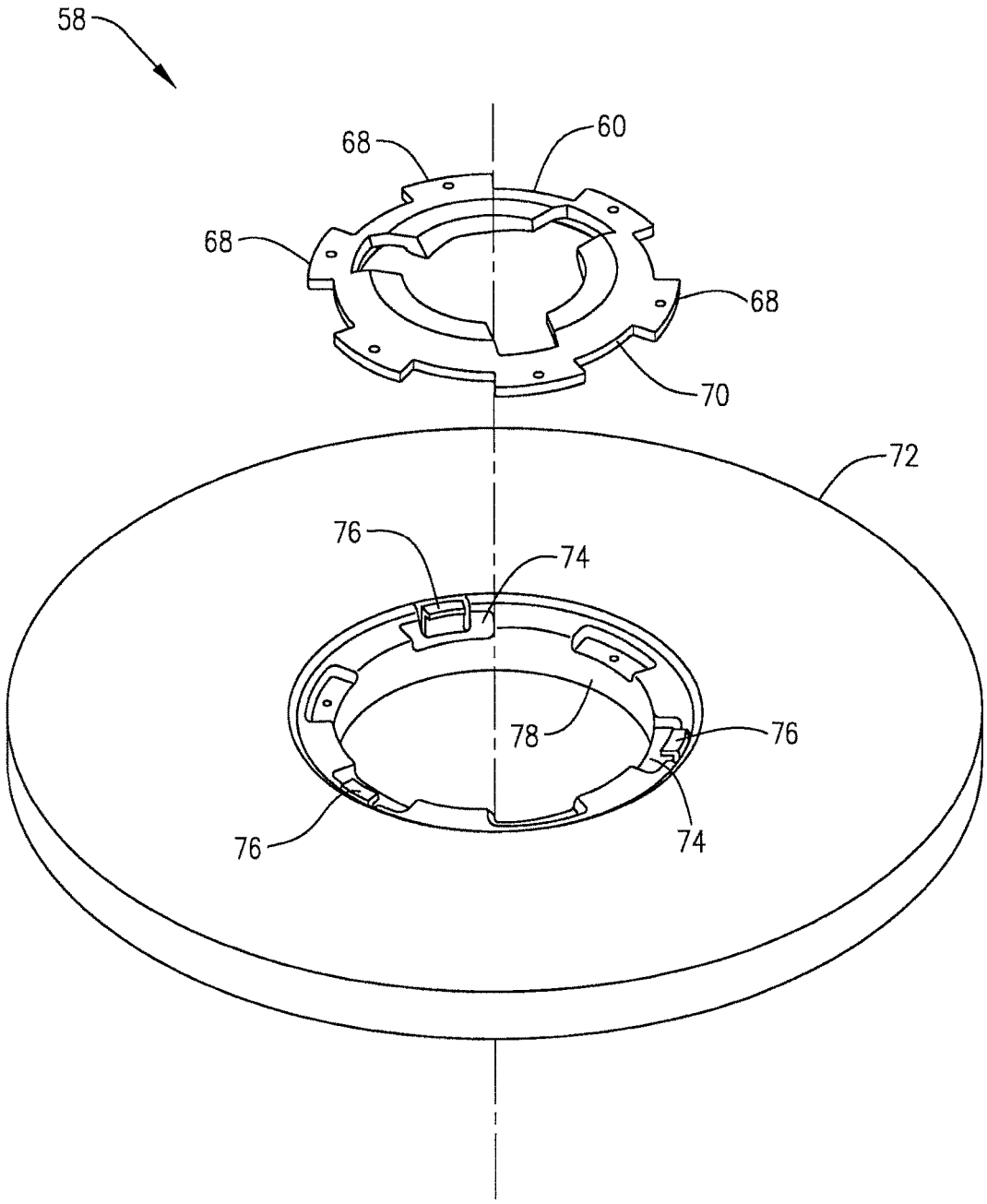
FIG. 5 is an explosive view of another embodiment of a scrubbing plate assembly in accordance with the current invention.
Figure 8:
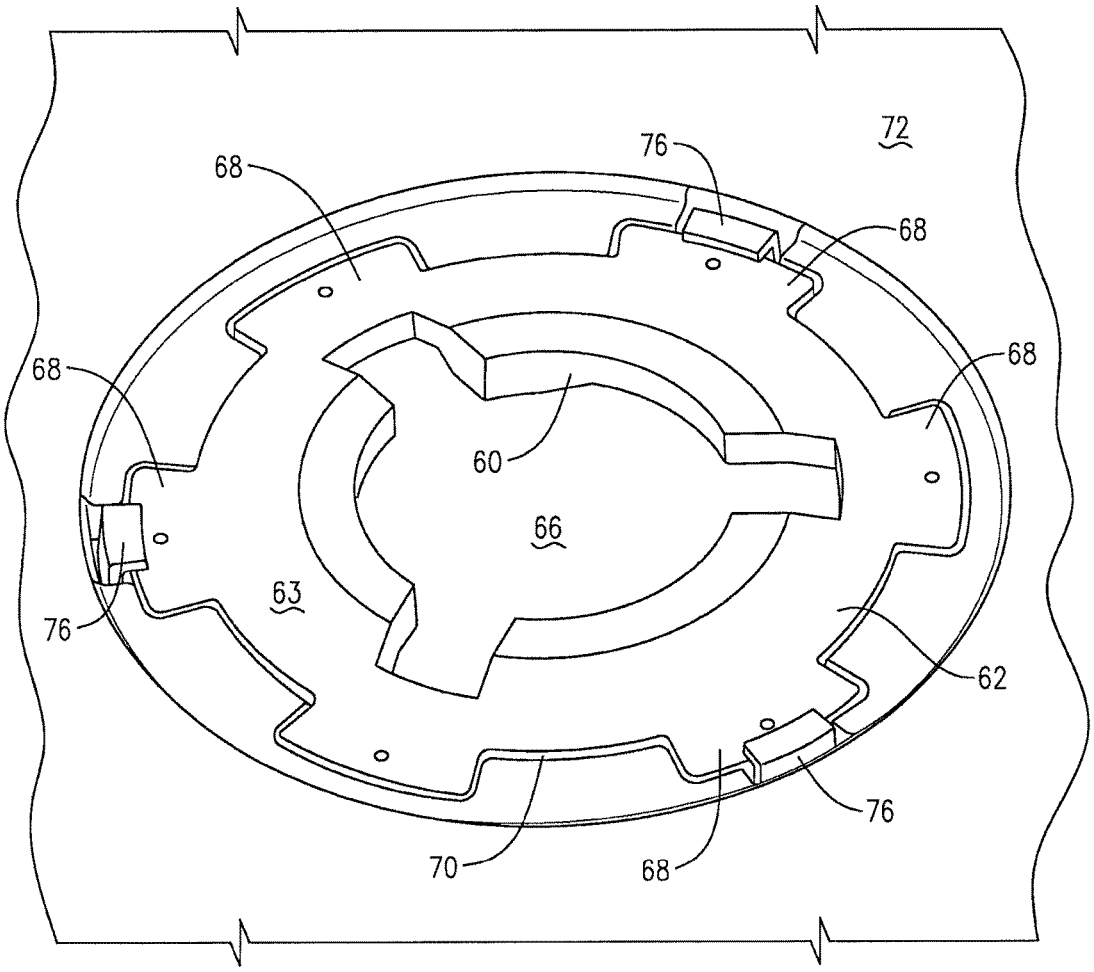
FIG. 8 is a cross-sectional view of the latching system taken along section line 8-8 of FIG. 7.
Figure 7:
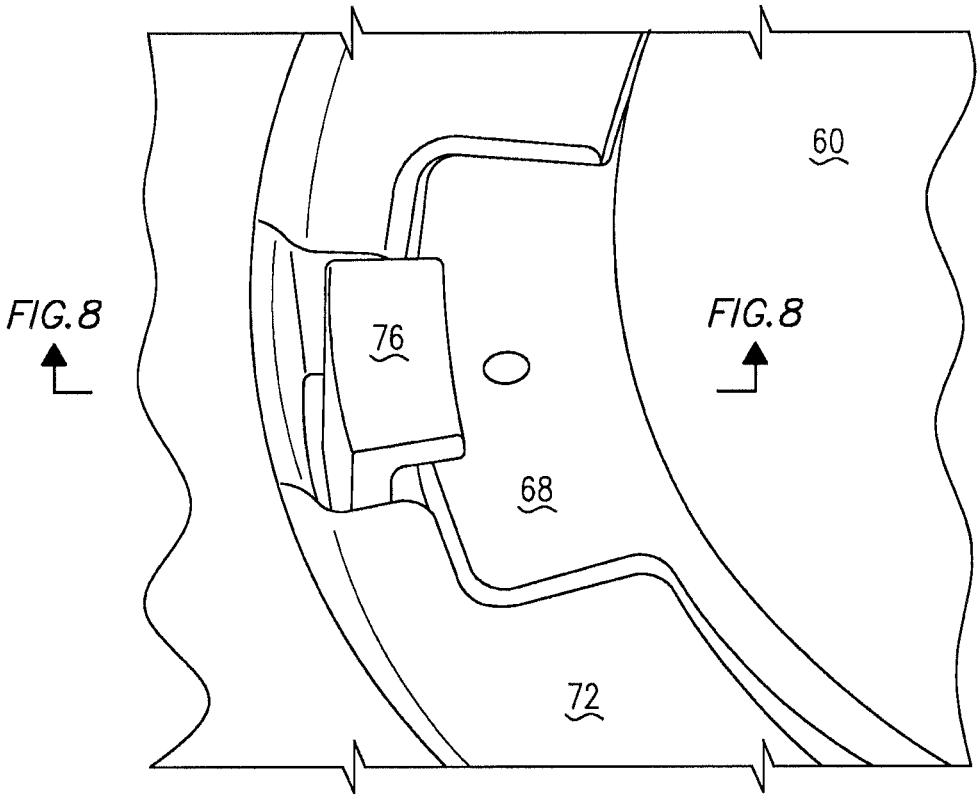
FIG. 7 is a perspective view of the latching system of the embodiment of FIG. 5.
Figure 8:
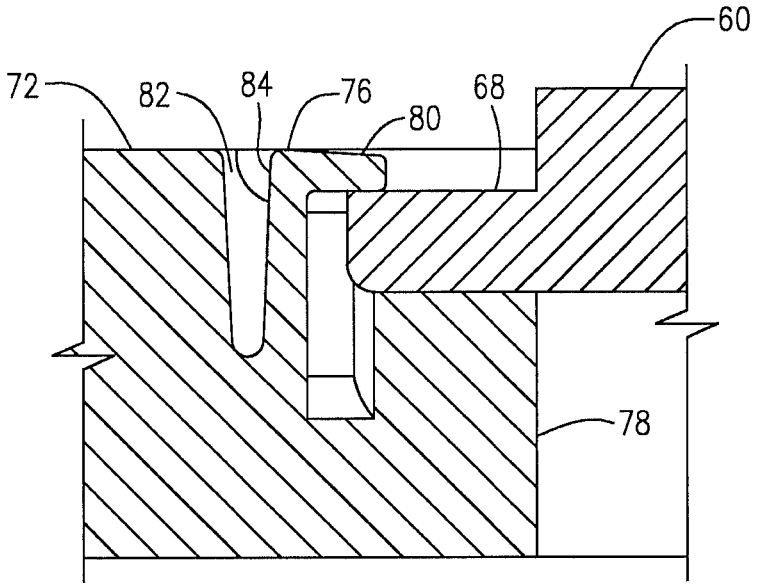
Figure 8:
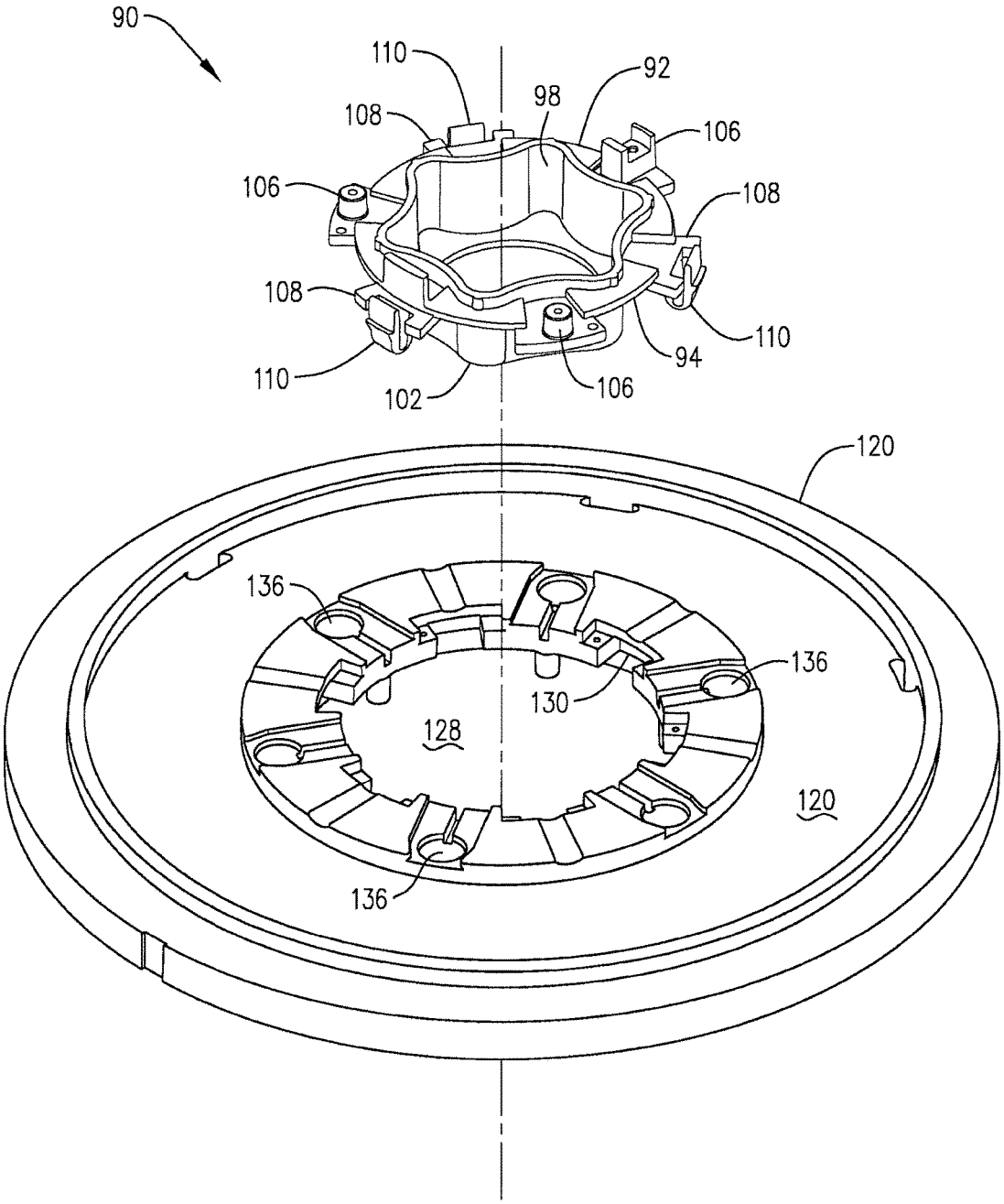
Figure 10:
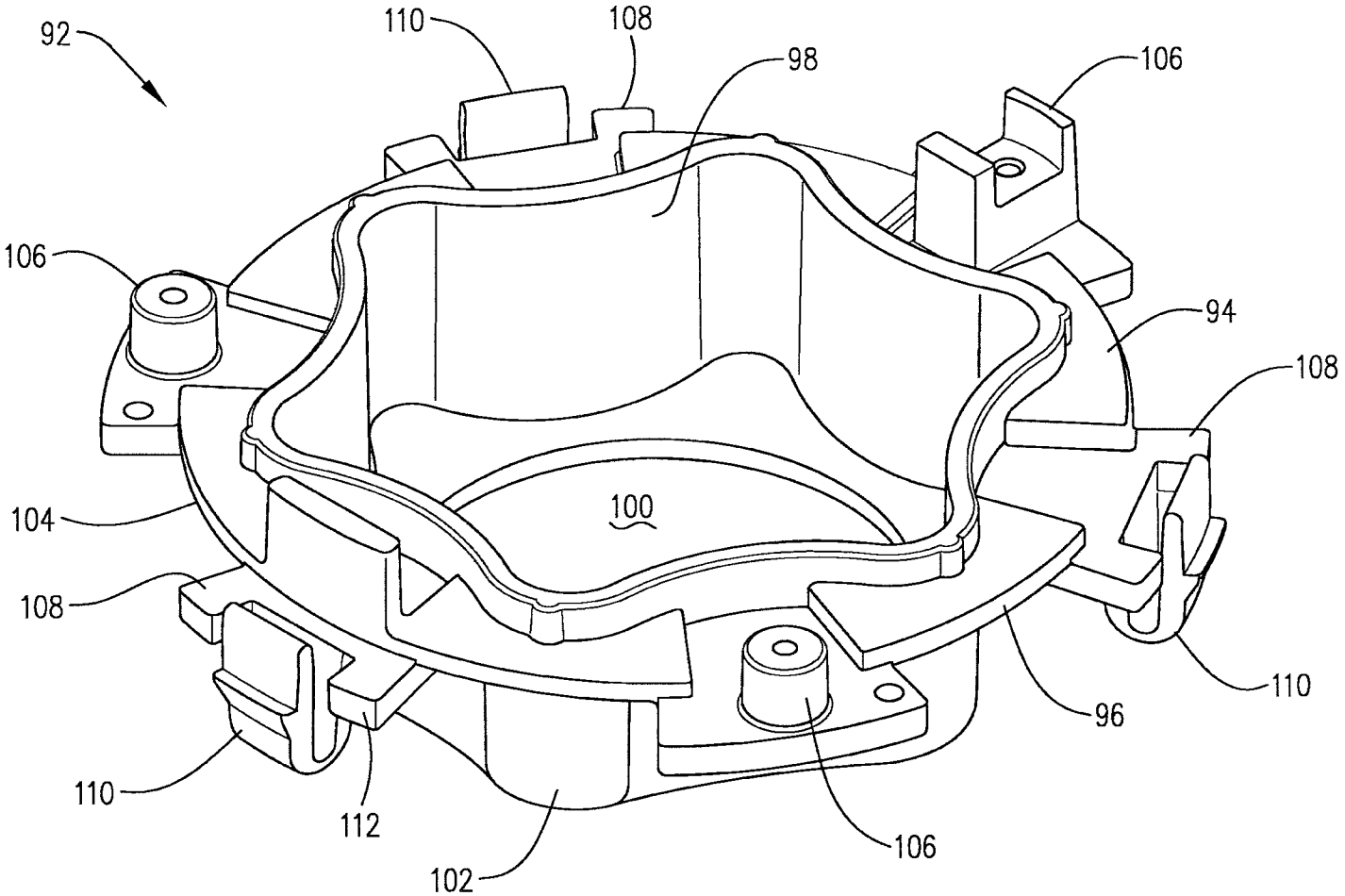
FIG. 10 is a perspective view of the adapter plate of the embodiment of FIG. 9.
Figure 11:
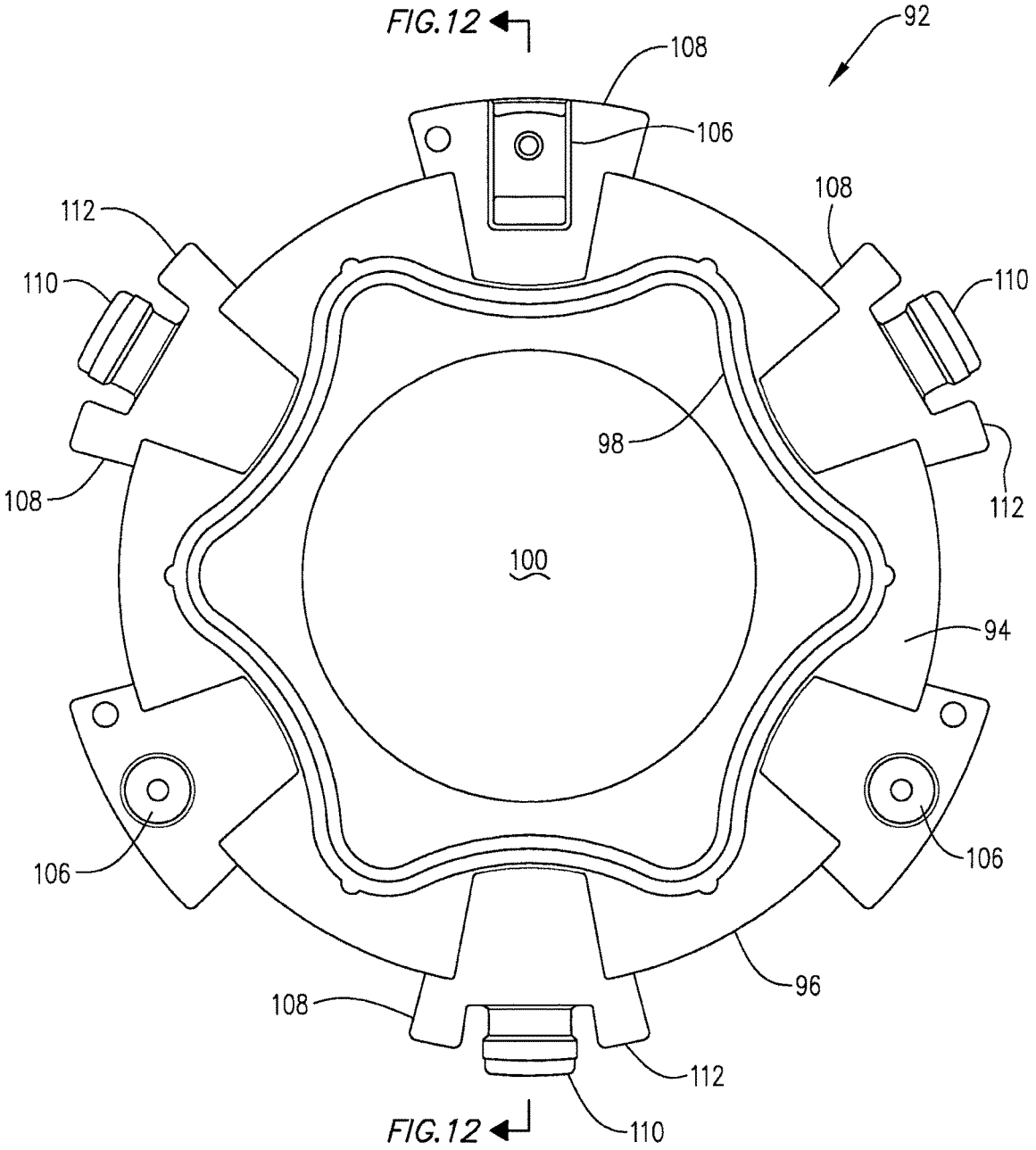
FIG. 11 is a top plane view of the adapter plate of the embodiment of FIG. 9.
Figure 12:
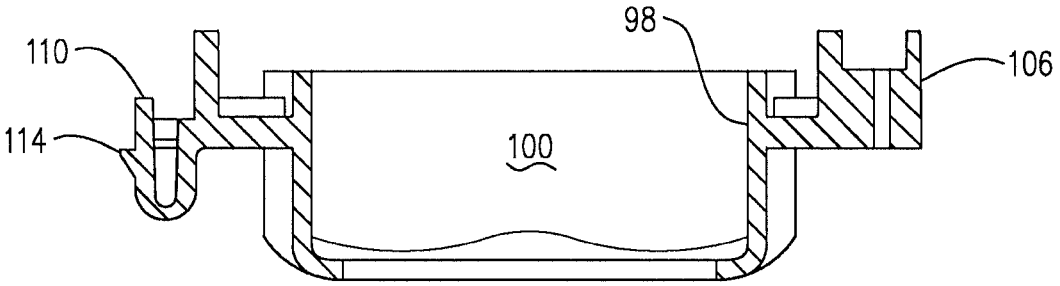
FIG. 12 is a cross-sectional view taken along section line 12-12 of FIG. 11.
Figure 13:
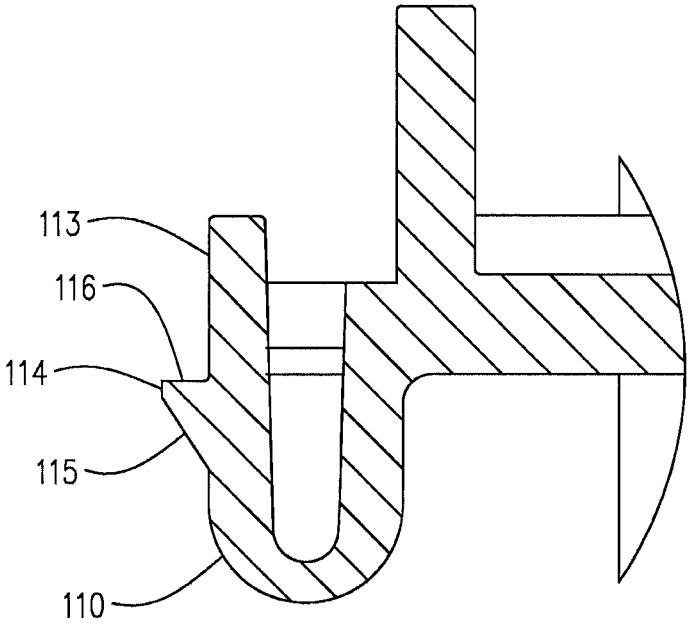
FIG. 13 is a cross-sectional enlargement of the latch system illustrated in FIG. 12.
Figure 14:
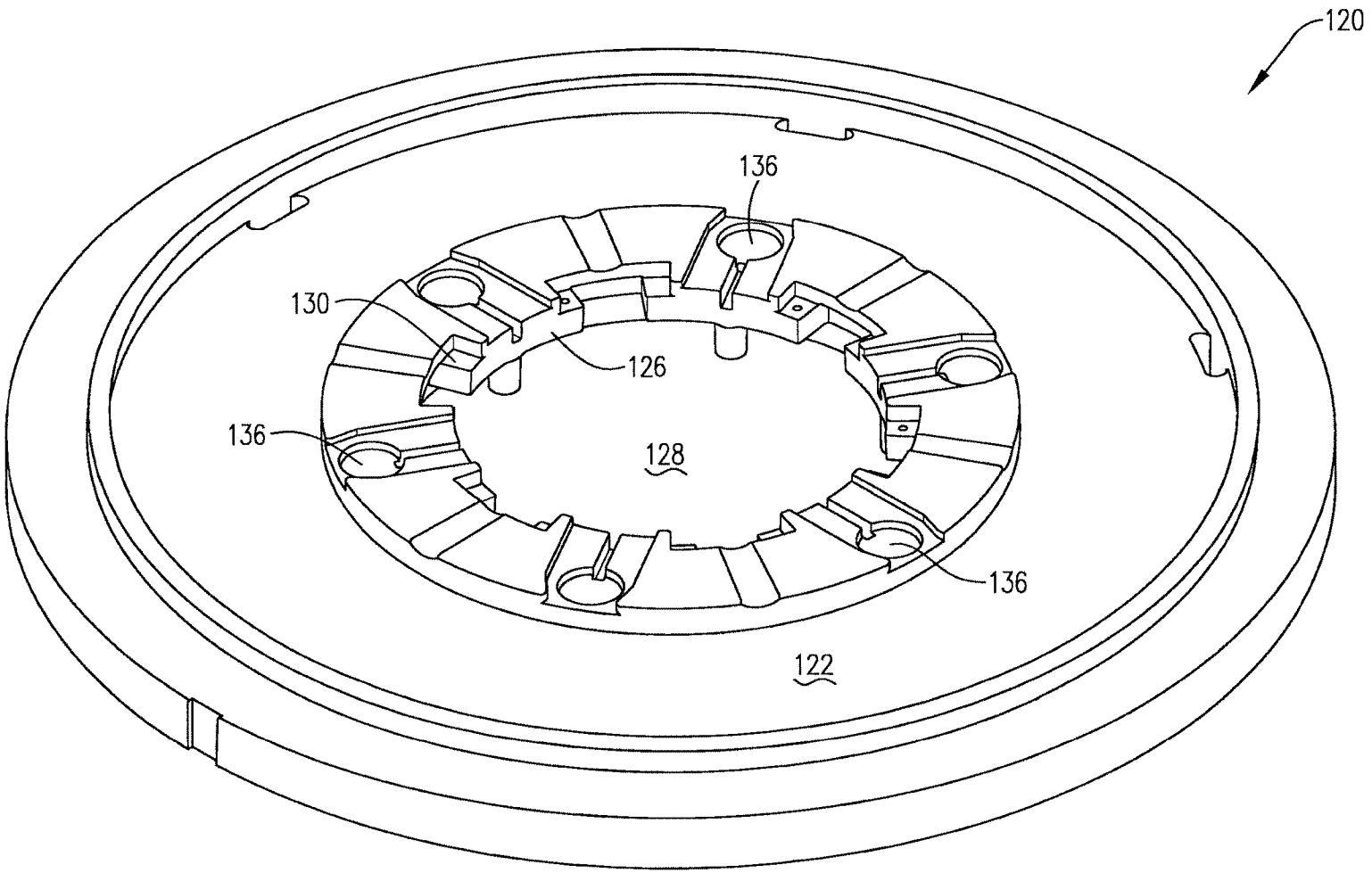
FIG. 14 is a perspective view of a scrubbing plate of the embodiment of FIG. 9.
Figure 15:
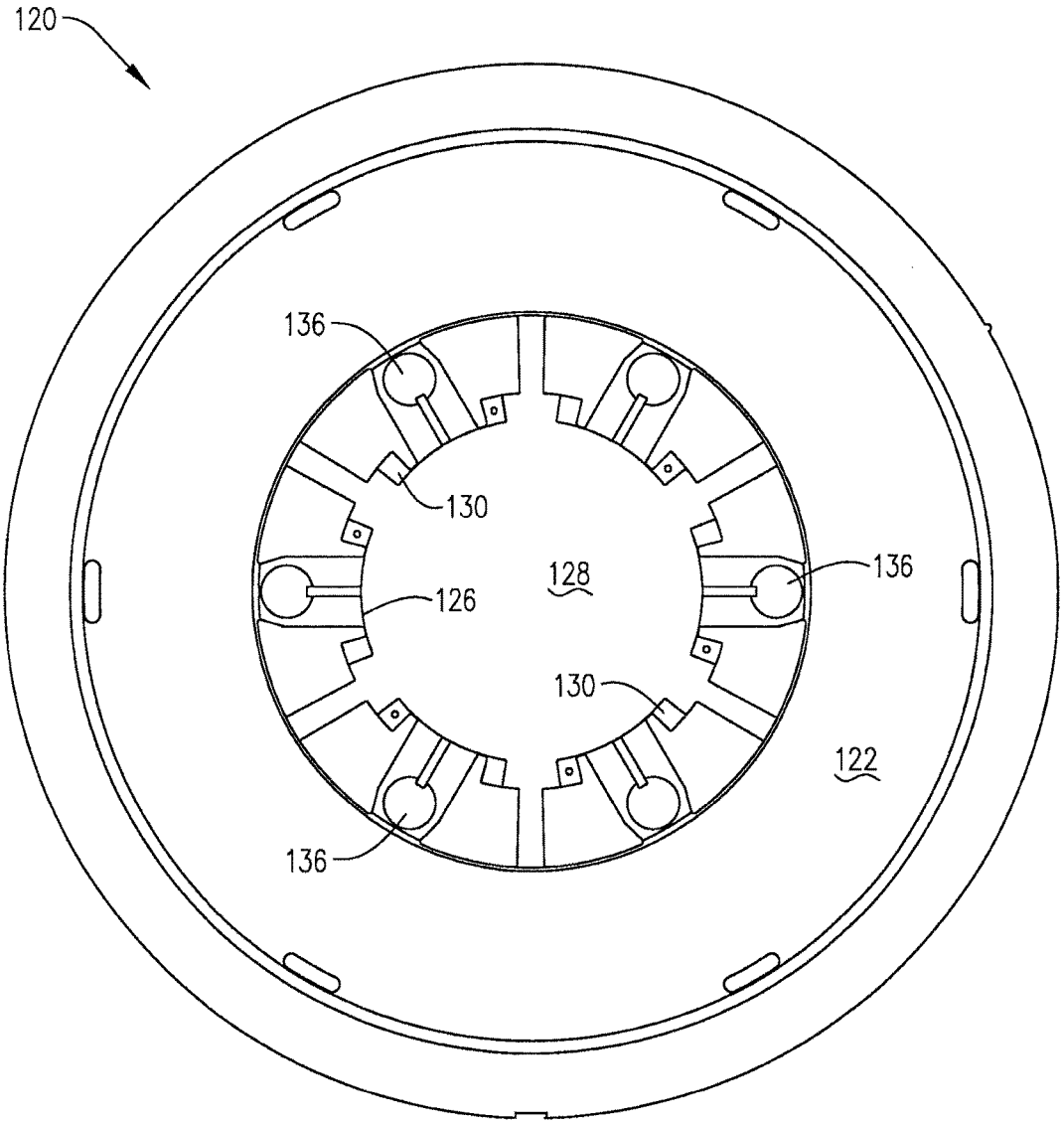
FIG. 15 is a top plane view of the scrubbing plate of FIG. 14.
Figure 15:
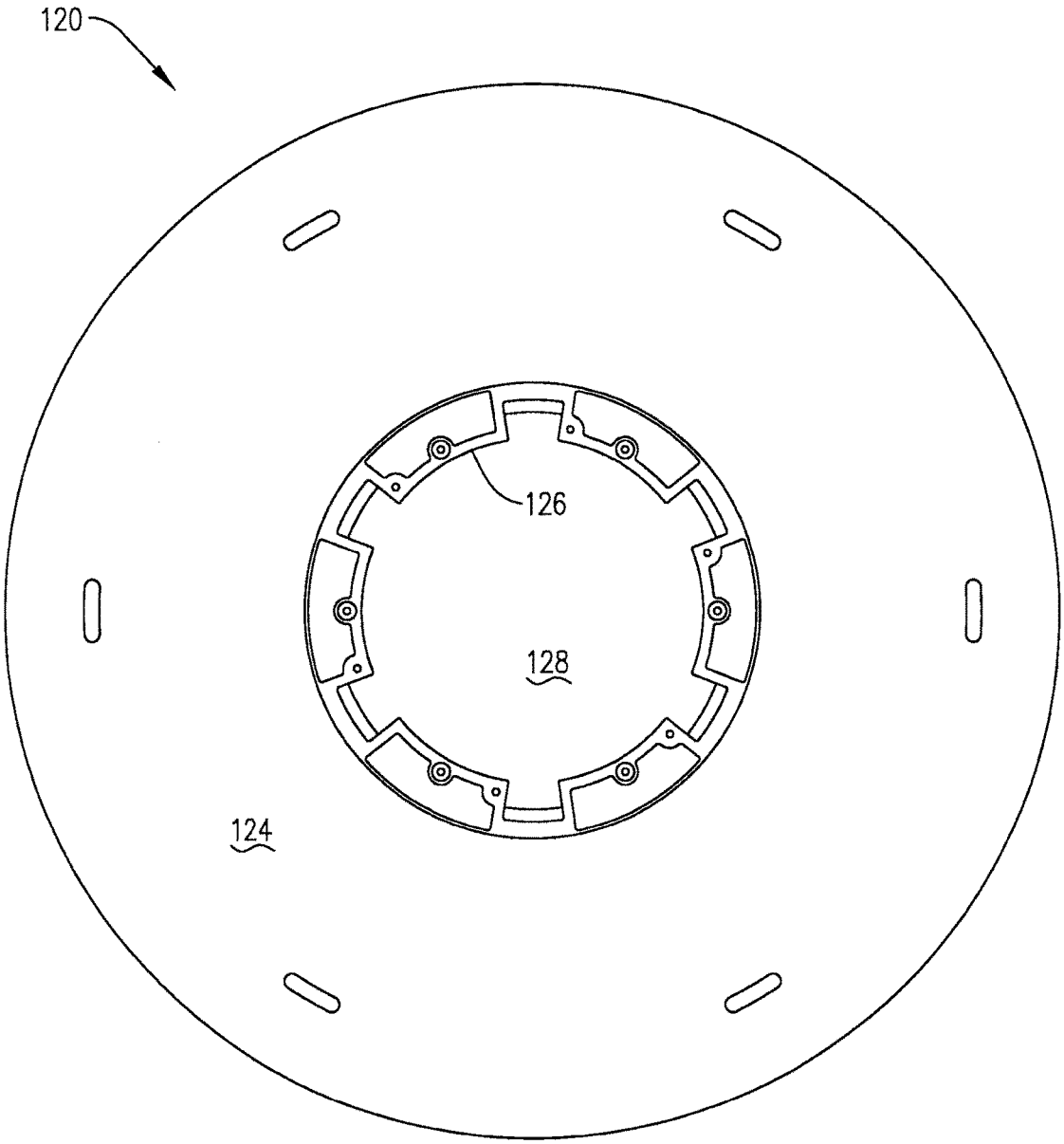
Figure 17:
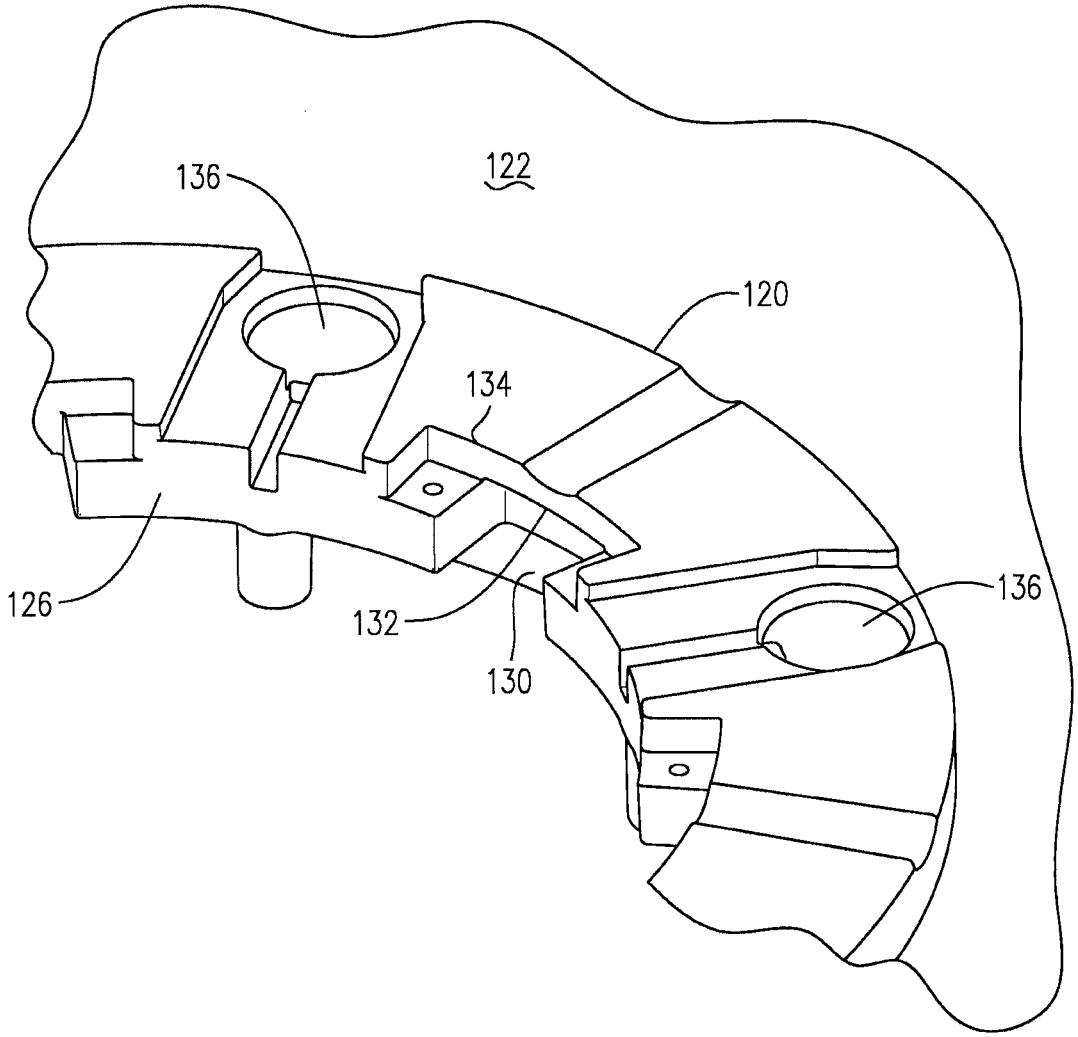
FIG. 17 is an enlargement of the latching system section of the scrubbing plate illustrated in FIG. 14.
Figure 7:
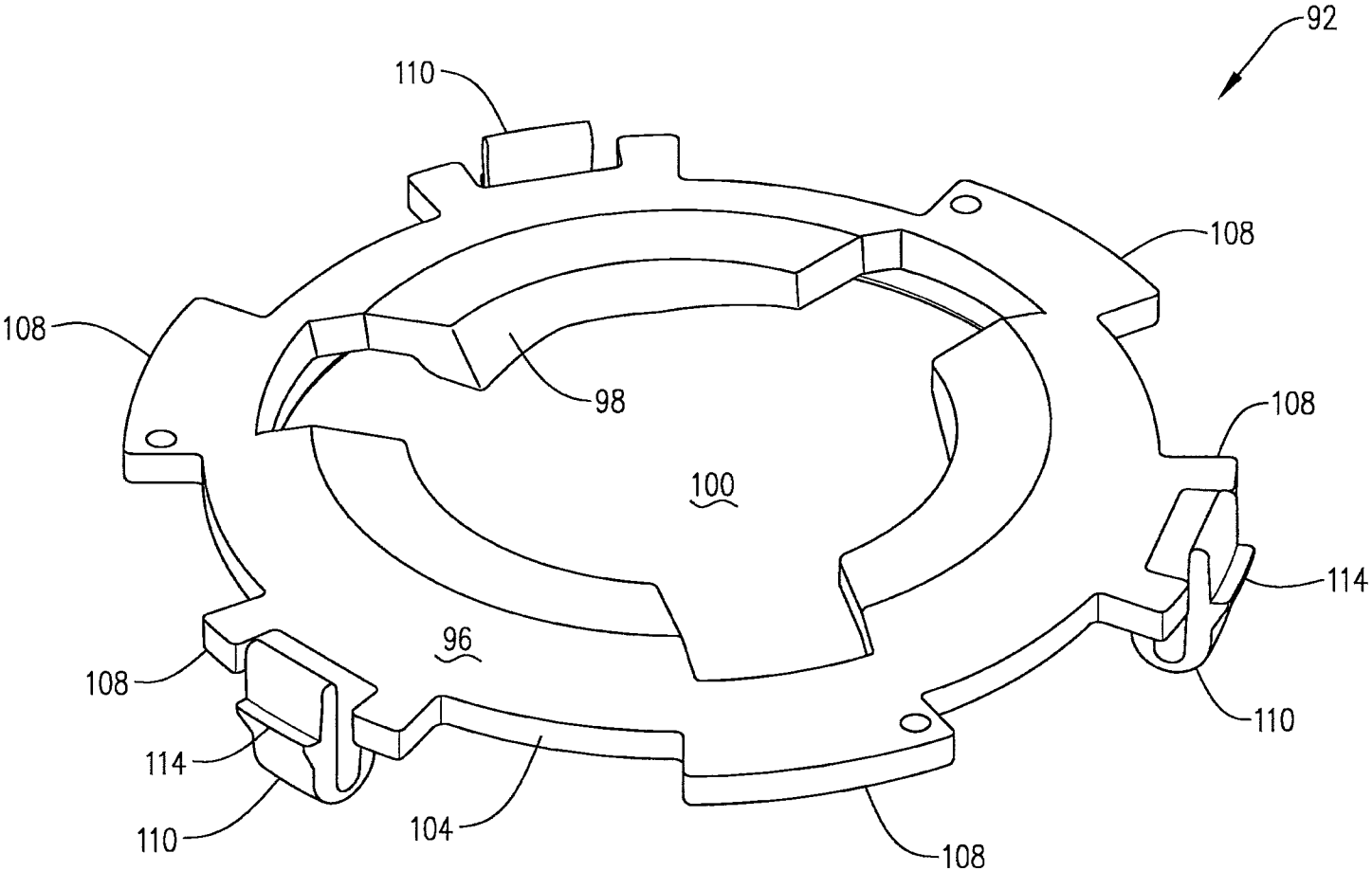
Figure 13:
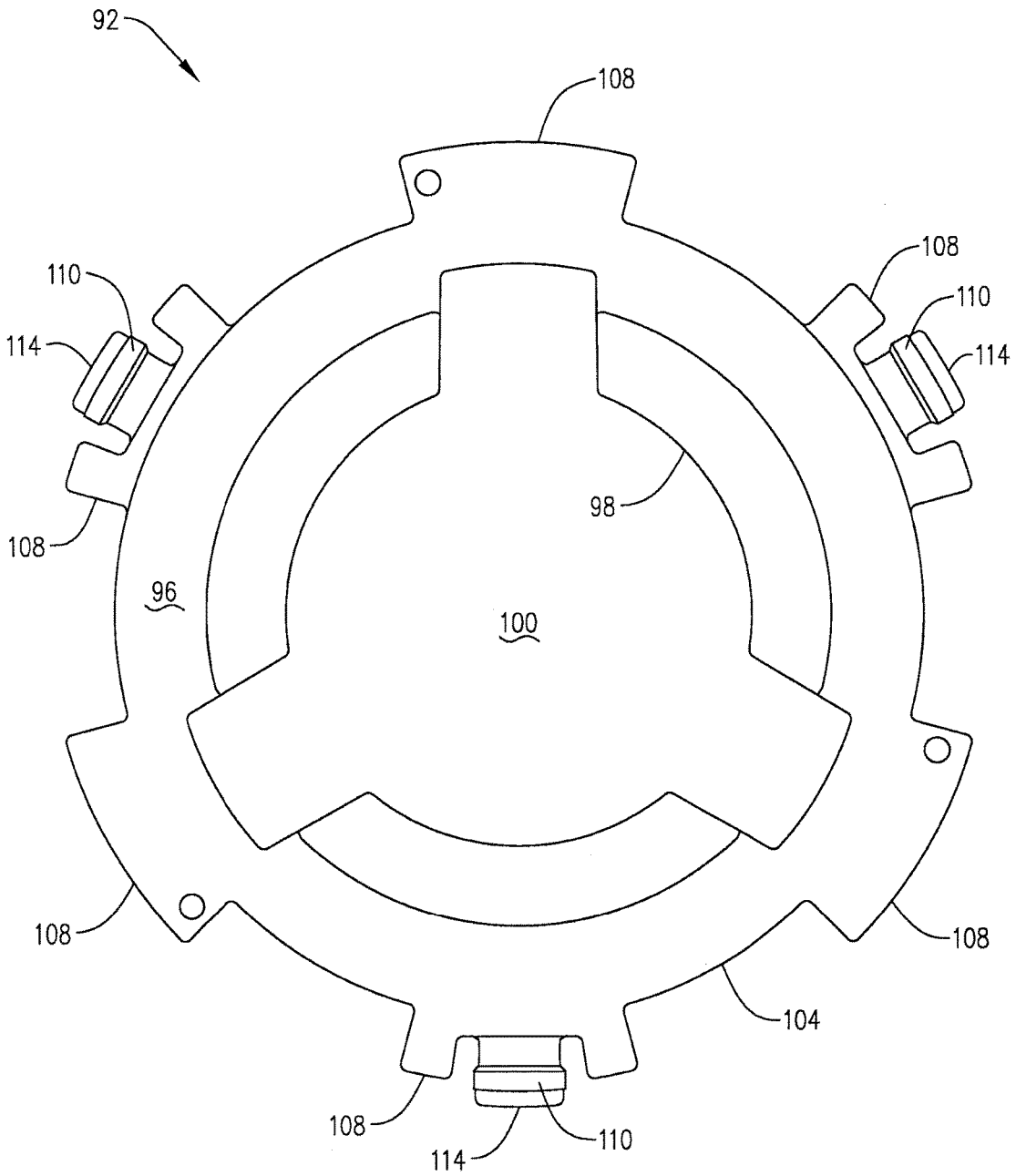

Adapter plate 10 can best be seen with reference to FIGS. 3 and 4. In accordance with one embodiment of the current invention, adapter plate 10 is suitable for mating with a variety of clutch assemblies. In accordance with another embodiment of the current invention, adapter plate 10 has a snap-fit system for easy connection to a scrubbing plate. Adapter plate 10 comprises a plate or ring 12 having a center edge 14, a first side or clutch plate mating side 18, an outer edge 24 and a second side or scrubbing plate mating side 28. Center edge 14 defines a central aperture 16.

As can best be seen from FIG. 3, a first side or clutch plate mating side 18 of adapter plate 10 has a first plurality of mounting holes 20 located adjacent to and spaced circumferentially around the center edge such that a keyed-type clutch plate 54 of a keyed-drive system can be attached securely to the adapter by any suitable means, such as by screws 56 (as shown in FIG. 2). Additionally, adapter 10 has ears 22 extending radially outward from an outer edge 24 with mounting holes 26 located in each ear 22. As can be seen from FIG. 2, this second plurality of mounting holes 26 are located radially outward from the central aperture 16 and the first plurality of mounting holes 20 and are spaced circumferentially about the plate such that a plurality of lugs 50 of a lug-type drive system can be mounted on the plate (as can be seen from FIG. 1) and such that lugs 50 can be mounted to the lug-type drive system while being mounted on the plate. Thus, it can be seen that by mounting the appropriate clutch mechanism onto adapter 10, first side 18 is configured to attach to a drive system of a rotary floor scrubbing machine.

As can best be seen from FIG. 4, ears 22 on the second side or scrubbing plate mating side 28 of adapter 10 can have nubs or protuberances 33, which are illustrated as being circular but can have other shapes. Additionally, second side 28 has a plurality of primary splines or primary fingers 30 and secondary splines or secondary fingers 32 located about the periphery of aperture 16 and extending longitudinally or axially out from second side 28. Primary and secondary splines 30 and 32 have a base 27 and a tip 29. Primary fingers 30 are longer than secondary fingers 32 and have a shoulder or latching projection 31 located on the tip 29 of primary fingers 30. Shoulder 31 securely latches adapter plate 10 to scrubbing plate 34, as described below.

Referring now to FIGS. 1 and 2, scrubbing plate 34 has a first side or mounting side 35, which mates with second side of 28 of adapter 10. Scrubbing plate 34 has a second side or scrubbing side, which has a scrubbing element or brush bristles 37 mounted thereon. Scrubbing plate 34 has a central edge 39 defining a central aperture 40. Central edge 39 has primary grooves 36, which can be called slots, indentions or notches. Additionally, central edge 39 has secondary grooves 38, which can be called slots, indentions or notches. Mounting side 35 of scrubbing plate 34 can also have indentations 42 located radially outward from aperture 40 and edge 39, and spread circumferentially about mounting side 35.

As can best be seen from FIGS. 1 and 2, primary fingers 30 fit in primary grooves 36 on scrubbing plate 34. Shoulders 31 of primary splines 30 latch over lower corner 41 of central edge 39; that is, the corner formed by central edge 39 and the second side of scrubbing plate 34. By latching over lower corner 41, shoulders 31 latch against the scrubbing side of scrubbing plate 34 to securely lock the adapter plate 10 and scrubbing plate 34 together. Additionally, primary fingers 30 are resilient so that they can be elastically bent radially inward for sliding into place in grooves 36 or for removal from grooves 36 and afterward return to their original axial and radial alignment. Thus, primary splines 30 secure scrubbing plate 34 from rotational and axial movement in relation to adapter plate 10 and, hence, the drive assembly. Secondary splines 32 fit in secondary grooves 38 of scrubbing plate 34 to further secure scrubbing plate 34 for undesirable rotational movement. Nubs 33 of ears 22 mate with indentations 42 on mounting side 35 of scrubbing plate 34 to further secure scrubbing plate 34 and adapter plate 10 from relative rotational movement.

As can be seen in FIGS. 1 and 2, clutch mechanisms can be attached to adapter plate 10. Adapter plate 10 is configured to accept various types of clutch plats for attachment to drive assemblies. FIG. 1 shows the mounting for a lug-type drive assembly. Clutch lugs 50 can be mounted to ears 22 by any suitable method. As illustrated, clutch lugs 50 are mounted by means of screws 52, which mate with mounting holes 26 of ears 22.

FIG. 2 shows the mounting for a keyed-type drive assembly. Keyed-type clutch plate 54 can be mounted to adapter plate 10 by any suitable method. As illustrated, clutch plate 54 is mounted by means of screws 56, which are received by mounting holes 20 of adapter plate 10. It will be noted that secondary fingers 32 serve as receivers for screws 56.

In operation, a clutch mechanism, such as a clutch plate 54 or lugs 50, which is consistent with the drive assembly of the rotary floor scrubbing machine, is mounted onto the adapter plate 10 as described above. The mated clutch mechanism and drive plate 10 can then be mounted on the rotary floor-scrubbing machine either before or after adding on a scrubbing plate 34. The scrubbing plate 34 is attached to adapter plate 10 by aligning the primary and secondary grooves 36 and 38 of the scrubbing plate 34 with the primary and secondary fingers 30 and 32 on the adapter plate 10 and applying longitudinal or axial pressure on the scrubbing plate 34 towards the adapter plate 10. The shoulders 31 of splines 30 can be angled so that under the application of the longitudinal pressure towards adapter plate 10, primary splines 30 will bend radially inward and then snap back to a latched position after scrubbing plate 34 has been mated with adapter plate 10. Subsequently, when the scrubbing plate 34 needs to be replaced scrubbing plate 34 can be removed by bending the primary splines 30 inward and asserting longitudinal pressure on scrubbing plate 34 away from adapter plate 10. Thus, the latching system for scrubbing plate 34 and adapter plate 10 locks under axial movement of adapter plate 10 relative to scrubbing plate 34. This allows the plate 34 to be removed without removal of the clutch mechanism.

Turning now to FIGS. 5-8, another embodiment of the current invention is illustrated. FIGS. 5-8 show a scrubbing plate assembly 58 for use on a rotary floor scrubbing machine. Scrubbing plate assembly 58 comprises an adapter plate 60 and a scrubbing plate 72. Adapter plate 60 is also a driver plate in that it combines a clutch plate and adapter plate into a single integral molded unit. The adapter plate 60 is shown as only incorporating a driver plate for a keyed-type drive assembly but could also incorporate lug ears to be useable with a lug-type drive assembly. Thus, adapter plate 60 can be configured to mate with either a key-type drive system or a lug-type drive system. Drive plate 60 comprises a plate or ring 62 having a first side or clutch mating side 63, a center edge 64, a second side or scrubbing plate side (not shown in FIGS. 5-8) and an outer edge 70. Center edge 64 defines a central aperture 66. Center edge 64 has the form of the appropriate key-type shape so that it can engage with a key-type drive assembly.

A plurality of radial splines 68 are located about the periphery of outer edge 70 of plate 62 and extend radially outward therefrom. Radial splines 68 fit in grooves 74 along central edge 78 of scrubbing plate 72. At least a portion of grooves 74 have a latch 76 located adjacent to center edge 78 or forming a part of center edge 78. Latch 76 is resilient so that it can be elastically bent radially outward for sliding adapter plate 60 into position with each spline 68 in a groove 74. In its relaxed position, projecting element or shoulder 80 of latch 76 extends out and over spline 68 locking adapter plate 60 into position. Gap 82 is provided on the radially outward side 84 of latch 76 to allow for the radially outward movement of latch 76 during the installation and removal of adapter plate 60. As will be appreciated, latch 76 is a compression clip which can be radially compressed so as to allow attachment and detachment of the adapter. Accordingly, the latching system for scrubbing plate 72 and adapter plate 60 locks under axial movement of adapter plate 10 relative to scrubbing plate 34. Additionally, shoulder 80 can have an angled upper surface so as to facilitate latching adapter plate 60 onto scrubbing plate 72.

When adapter plate 60 is latched onto scrubbing plate 72, splines 68 and grooves 74 mate to securely lock the two together so that scrubbing plate 72 does not move rotationally and axially in relation to adapter plate 10 and, hence, the drive assembly. Rather, the drive assembly imparts rotational movement to drive plate 60, which imparts it to scrubbing plate 72.

In operation, scrubbing plate 72 is attached to adapter plate 60 by aligning the grooves 74 of scrubbing plate 72 with the radial splines 68 on drive plate 60 and applying longitudinal or axial pressure on scrubbing plate 72 towards drive plate 60. Latches 76 can be moved outward to facilitate mating or can be have an angled edge on shoulder 76 so that under the application of the axial pressure latch 76 will bend radially inward and then snap back to a latched position after scrubbing plate 34 has been mated with adapter plate 10. Subsequently, when scrubbing plate 72 needs to be replaced, it can be removed by bending latches 76 radially outward and asserting axial pressure on the scrubbing plate 34 away from the adapter plate 10. Thus, the latching system for scrubbing plate 34 and adapter plate 10 locks under axial movement of adapter plate 10 relative to scrubbing plate 34.

Turning now to FIGS. 9-17, a further embodiment of the current invention is illustrated. FIGS. 9-17 show a scrubbing plate assembly 90 for use on a rotary floor scrubbing machine. Scrubbing plate assembly 90 comprises an adapter plate 92 and a scrubbing plate 120. Adapter plate 92 is also a driver plate in that it combines a clutch mechanism and adapter plate into a single integral molded unit. The adapter plate 92 is shown in FIGS. 8-14 as incorporating a driver plate for a keyed-type drive assembly but can incorporate other clutch mechanisms as illustrated in FIGS. 18-21. Thus, adapter plate 92 can be configured to attach to a drive system of a rotary scrubbing floor machine. Adapter plate 92 comprises a plate or ring 94 having a first side or clutch mating side 96, a center edge 98, a second side or scrubbing plate side 102 and an outer edge 104. Center edge 98 defines a central aperture 100. In FIGS. 9-17, center edge 98 has the form mateable with a star-shaped drive hub of a rotary floor scrubbing machine. Accordingly, adapter plate 92 includes mounting elements 106 for attaching a retainer to secure the adapter plate to the drive hub.

A plurality of radial splines 108 are located about the periphery of outer edge 104 of plate 92 and extend radially outward therefrom. At least a portion of radial splines 108 have a latch 110, which form a part of the radially outer edge 112 of radial splines 108. Latch 110 has projecting element or shoulder 114 on its radially outer side 113. Shoulder 114 has wedge or incline surface 115 and ledge 116. Latch 110 is resilient so that it can be elastically bent radially inward. As illustrated, this is achieved by latch 110 having a generally U-shaped configuration. Accordingly, latch 110 is a compression latch.

As can best be seen from FIGS. 14-17, scrubbing plate 120 comprises a disk having a first side or mounting side 122, a second side or scrubber side 124 and center edge 126. Second side 124 will typically have bristles, a pad or another similar scrubbing element mounted thereon. Center edge 126 defines an aperture 128. First side 122 and center edge 126 are configured for receiving adapter plate 92. Thus, there are grooves 130 along center edge 126, which are configured to receive radial splines 108 in mating relationship. Grooves 130 have a projecting element or shoulder 132 defined therein. Shoulders 132 are oriented so as to be in opposition with shoulders 114 of adapter plate 92 so that, when adapter plate 92 is mated with the scrubbing plate 120, shoulder 114 locks with shoulder 132 and prevents relative axial movement; that is axial movement of adapter plate 92 relative to scrubbing plate 120.

Scrubbing plate 120 can also have indentations 136, which are utilized with adapter plates designed for lug drive systems, as described below for FIGS. 20 and 21. Indentations 136 are circumferentially spaced about aperture 100 on first side 96.

In operation, scrubbing plate 120 is attached to adapter plate 92 by aligning the grooves 130 of scrubbing plate 120 with the radial splines 108 on adapter plate 92 and applying longitudinal or axial pressure to move the two plates towards each other. When the adapter plate 92 and scrubbing plate 120 are appropriately aligned and axial force is applied to move the two plates towards one another, wedge surface 115 will come in contact with the first side 122 of scrubbing plate 120 at the edge 134, which is formed from groove 130 and first side 122. Continued axial force will cause latch 110 to radially compress; thus, allowing grooves 130 to mate with splines 108. After shoulder 114 passes over shoulder 132, latch 110 returns to its relaxed or uncompressed position. In its relaxed position, shoulder 114 of latch 110 extends out and across shoulder 132; thus, the two shoulders mate locking adapter plate 92 into position on scrubbing plate 120. As will be appreciated, latch 110 is a compression clip which can be radially compressed so as to allow attachment and detachment of the adapter. Accordingly, the latching system for scrubbing plate 120 and adapter plate 92 locks under axial movement of adapter plate 92 relative to scrubbing plate 120. Latch 110 can be radially compressed by pressure on radially outer side 113 thus allowing detachment of adapter plate 92 from scrubbing plate 120.

When adapter plate 92 is latched onto scrubbing plate 120, splines 108 and grooves 130 mate to securely lock the two together so that scrubbing plate 120 does not move rotationally and axially in relation to adapter plate 92 and, hence, the drive assembly. Rather, the drive assembly imparts rotational movement to adapter plate 92, which imparts it to scrubbing plate 120.

Figure 20:
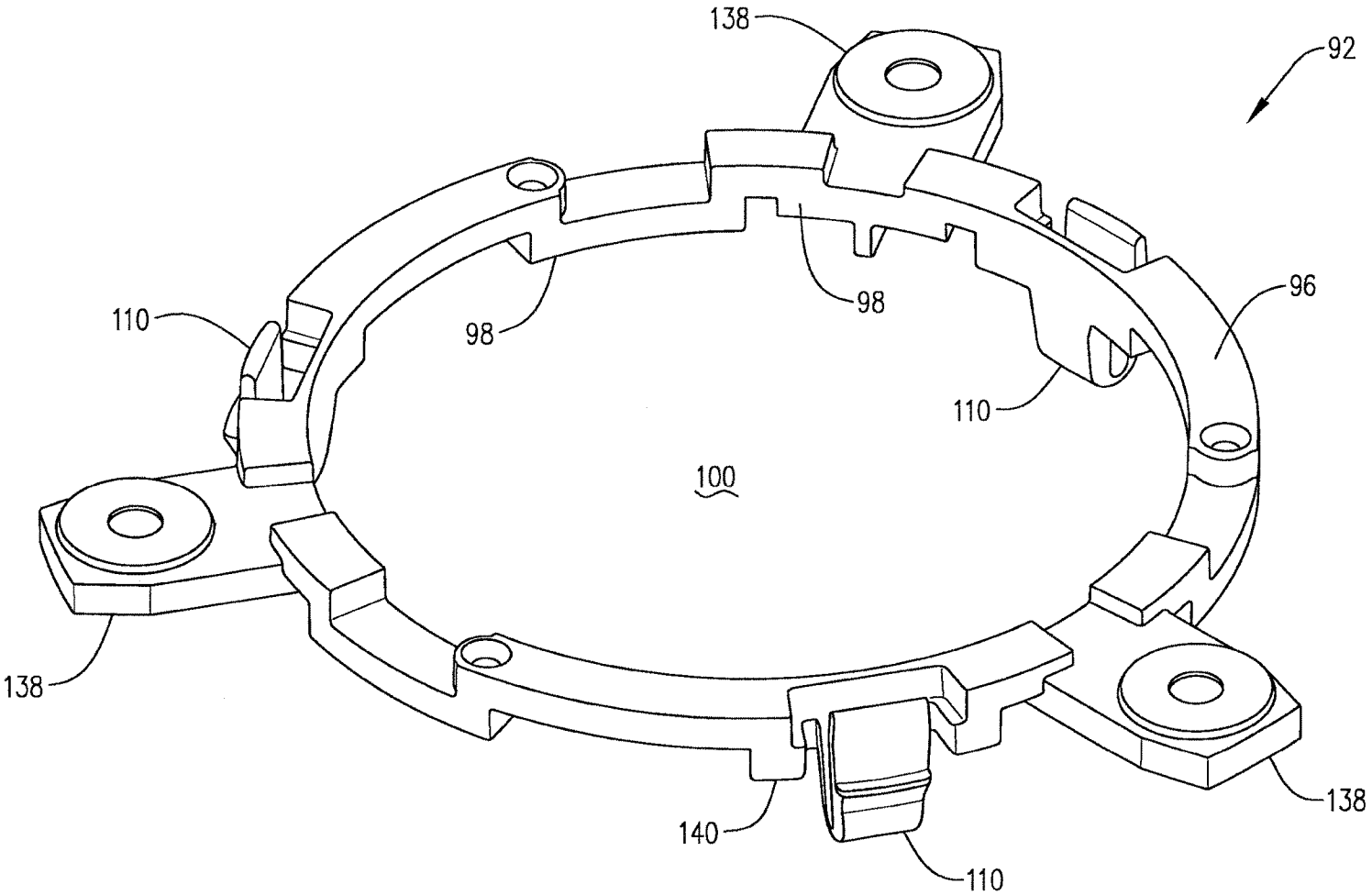
FIG. 20 is another embodiment of an adapter plate in accordance with the invention. The adapter plate utilizes the same latching system as the embodiment of FIG. 9.
Figure 21:
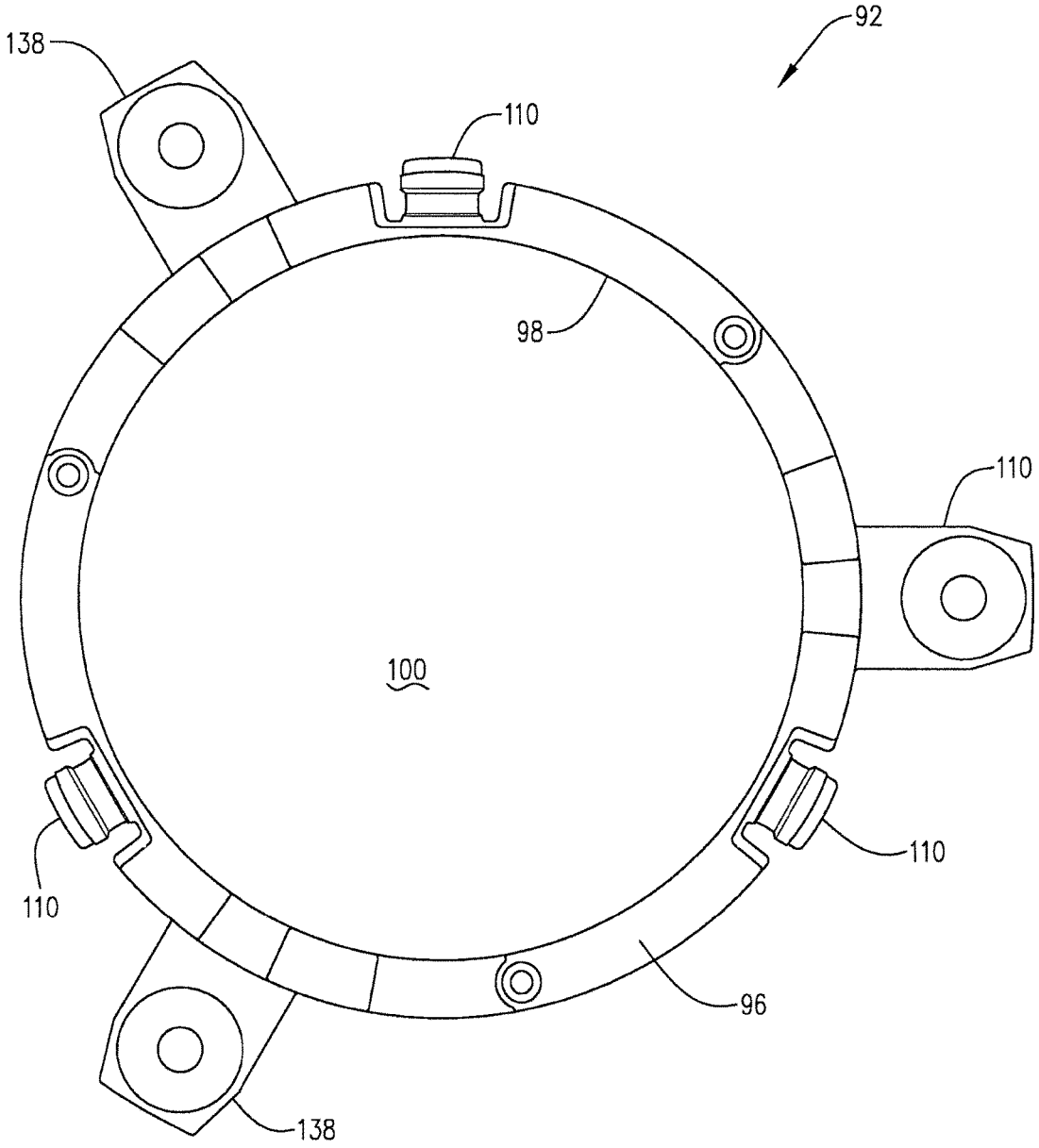
FIG. 21 is a top plane view of the adapter plate of FIG. 20.

Turning now to FIG. 18-21 alternative embodiments of adapter plate 92 are shown. In FIGS. 18 and 19, center edge 98 defines an aperture 100 in the form mateable with a key-type drive of a scrubbing machine. Adapter plate 92 has a wedged thickness along center edge 98 to facilitate locking with a key-type drive. FIGS. 20 and 21 illustrate an adapter for use with a lug drive floor scrubber. Adapter plate 92 has lug ears 138 circumferentially spaced about outer edge 104. Lug ears 138 are configured to receive drive lugs. Lug ears 138 are additionally designed to mate with indentations 136 when adapter plate 92 is latched onto scrubbing plate 120. Additionally, it will be noted that the embodiment of FIGS. 20 and 21 has axially extending splines 140, which mate with grooves 130 of scrubbing plate 120. However, it will be appreciated that the adapter plate 92 can be configured with ear lugs 138 and radial extending splines.

Other embodiments of the current invention will be apparent to those skilled in the art from a consideration of this specification or practice of the invention disclosed herein. Thus, the foregoing specification is considered merely exemplary of the current invention with the true scope thereof being defined by the following claims.

What is claimed is:

1. An adapter plate for use in attaching a scrubbing plate to a rotary floor scrubbing machine, wherein said scrubbing plate has a mounting side and a scrubbing side and a central edge defining a central aperture, said adapter plate comprising:

a first side configured to attach to a drive system of said rotary floor scrubbing machine;

a second side configured to attach to said scrubbing plate by a latching system, which locks under axial movement of said adapter plate relative to said scrubbing plate when said second side of said adapter plate is aligned and in contact with said mounting side of said scrubbing plate; and an outer edge defining a periphery of said adapter plate; and wherein said latching system comprises:

a plurality of splines located about said periphery and extending radially outward therefrom; each said spline is configured to be mated within a corresponding groove along said central edge of said scrubbing plate so as to prevent rotational movement of said adapter plate relative to said scrubbing plate; and wherein a first portion of said splines has a compression clip having a generally U-shaped configuration with a first shoulder, said first shoulder configured to lock with a second shoulder on said corresponding groove such that, when said adapter plate is attached to said scrubbing plate, each spline of said first portion of said splines and said corresponding groove of said scrubbing plate mate so that said first shoulder and said second shoulder lock said adapter plate and scrubbing plate from relative axial movement; and wherein said compression clip is resilient so as to be elastically bent such that it can be radially compressed to allow attachment and detachment of said adapter plate from said scrubbing plate.

2. The adapter plate of claim 1, wherein said adapter plate has a central aperture having a key-type shape configured to mate with a key-type drive system.

3. The adapter plate of claim 1, wherein said adapter plate has a wedged thickness along the central aperture.

4. The adapter plate of claim 1, wherein said adapter plate has radial ears having lugs of a lug-type drive system mounted thereon.

* * * * *